US010276961B2

(12) United States Patent
Han et al.

(10) Patent No.: US 10,276,961 B2
(45) Date of Patent: Apr. 30, 2019

(54) PRINTED CIRCUIT BOARD DEVICE

(71) Applicant: Samsung Electronics Co., Ltd., Gyeonggi-do (KR)

(72) Inventors: Jung-Eun Han, Gyeonggi-do (KR); Yun-Sung Shin, Gyeonggi-do (KR); Ho-Chul Hwang, Seoul (KR)

(73) Assignee: Samsung Electronics Co., Ltd (KR)

( * ) Notice: Subject to any disclaimer, the term of this patent is extended or adjusted under 35 U.S.C. 154(b) by 138 days.

(21) Appl. No.: 14/600,779

(22) Filed: Jan. 20, 2015

(65) Prior Publication Data

US 2015/0207250 A1 Jul. 23, 2015

(30) Foreign Application Priority Data

Jan. 20, 2014 (KR) ..... 10-2014-0006718

(51) Int. Cl.
*H01R 12/71* (2011.01)
*H01R 13/24* (2006.01)

(52) U.S. Cl.
CPC ..... *H01R 13/24* (2013.01); *H01R 12/718* (2013.01)

(58) Field of Classification Search
CPC ..... H01R 13/24; H01R 12/718
See application file for complete search history.

(56) References Cited

U.S. PATENT DOCUMENTS 3,858,958 A * 1/1975 Davies ..... H01R 12/7082 361/785
3,985,413 A * 10/1976 Evans ..... H01R 12/714 439/591
4,109,378 A * 8/1978 Davies ..... H01R 43/007 264/267
4,533,976 A * 8/1985 Suwa ..... G11C 5/00 361/679.02
4,693,529 A * 9/1987 Stillie ..... H01R 12/52 439/493
5,588,846 A * 12/1996 Irlbeck ..... H01R 12/62 439/65
6,231,352 B1 * 5/2001 Gonzales ..... H01R 12/52 439/66
6,854,985 B1 2/2005 Weiss
7,419,378 B2 * 9/2008 Ha ..... G01R 1/0466 439/39
7,462,036 B2 * 12/2008 Shin ..... H01R 12/721 439/289
8,254,142 B2 8/2012 Chen
8,259,462 B2 * 9/2012 Hsu ..... H01R 12/57 361/767
8,740,642 B2 * 6/2014 Keenihan ..... H01R 31/00 439/510
2010/0134228 A1 * 6/2010 Chow ..... H01F 27/027 336/92
2013/0105198 A1 5/2013 Ogawa et al.

* cited by examiner

*Primary Examiner* — Briggitte R Hammond
(74) *Attorney, Agent, or Firm* — The Farrell Law Firm, P.C.

(57) ABSTRACT

A printed circuit board (PCB) device is provided, which includes a base board, a part, and a conductive elastic member configured to electrically connect the base board with the part. The conductive elastic member comprises a non-conductive body and at least one conductive interconnect port provided on the non-conductive body and configured to electrically connect an interconnect terminal of the base board with an interconnect terminal of the part.

13 Claims, 14 Drawing Sheets

PRINTED CIRCUIT BOARD DEVICE

PRIORITY

This application claims priority under 35 U.S.C. § 119(a) to a Korean Patent Application filed in the Korean Intellectual Property Office on Jan. 20, 2014 and assigned Serial No. 10-2014-0006718, the entire content of which is incorporated herein by reference.

BACKGROUND

1. Field of the Invention

The present invention generally relates to printed circuit boards (PCBs), and more specifically, to circuit board devices having conductive elastic members with various shapes and structures.

2. Description of the Related Art

A printed circuit board (PCB) is used in electronics to electrically connect various electronic components or parts, such as integrated circuits (ICs), resistors, switches, or other modularized electronic parts. Connectors for connecting electronic parts to PCBs may be classified into contact types and wire types.

FIG. 1A schematically illustrates a conventional contact-type connector. FIG. 1B schematically illustrates a conventional wire-type connector.

Referring to FIG. 1A, a contact-type connector 13 shaped as a C-clip is placed between a circuit board 12 and an electronic component 11, which are vertically stacked, to electrically connect the circuit board 12 and the electronic component 11.

As shown in FIG. 1B, a flat or bent wire-type connector 23 provides an electrical connection between a circuit board 22 and an electronic component 21, which are positioned adjacent to each other in a horizontal direction.

In order for the contact-type connector to electrically connect the electronic component and the circuit board, one of the electronic component and the circuit board is coupled with the connector, and the other is then placed in position. This type of connector may have the benefit of easy assembly and disassembly. To maintain the contact stability, the circuit board, the connector, and the electronic component need to be stacked one over another, instead of being positioned side by side. Such stacking may leave the circuit board device bulky.

The wire-type connector allows for both the side-by-side positioning and the stacking for an electrical connection between the electronic component and the circuit board. However, this connector type has a lower contact stability compared with the contact-type connector, and it requires a separate member (e.g., soldering) for secure mating between the electronic component and the circuit board. Accordingly, the wire-type connector is difficult to work with because of, for example, difficult assembling or disassembling the connector, the electronic component, and the circuit board. To address this issue, the connector may adopt a flexible circuit board for its wiring. However, the use of the flexible circuit board may result in increased costs.

SUMMARY

The present invention has been made to solve at least the above-mentioned problems and/or disadvantages and to provide at least the advantages described below.

Accordingly, an aspect of the present invention is to provide a circuit board device that enables electronic components and circuit boards to be installed at various positions.

Another aspect of the present invention is to provide a circuit board device that may provide easy assembly or disassembly together with a simplified manufacturing process.

Another aspect of the present invention is to provide a circuit board device that may diversify the position of the interconnect terminal of the part and the installed direction of the interconnect terminal of the circuit board.

Another aspect of the present invention is to provide a circuit board device that may reduce the installed thickness of the part and the circuit board.

According to an aspect of the present invention, a printed circuit board device is provided, which includes a base board; a part, and a conductive elastic member configured to electrically connect the base board with the part. The conductive elastic member comprises a non-conductive body and at least one conductive interconnect port provided on the non-conductive body and configured to electrically connect an interconnect terminal of the base board with an interconnect terminal of the part.

BRIEF DESCRIPTION OF THE DRAWINGS

The above and other aspects, features, and advantages of certain embodiments of the present invention will be better understood by reference to the following detailed description, when considered in connection with the accompanying drawings, in which.

DETAILED DESCRIPTION OF EMBODIMENTS OF THE PRESENT INVENTION

Figure 1A:
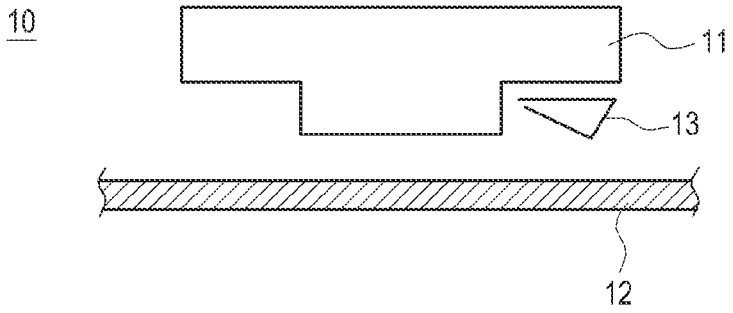
FIG.1A (PRIOR ART)
FIGS. 1A and 1B schematically illustrate a conventional circuit board device.
Figure 1B:
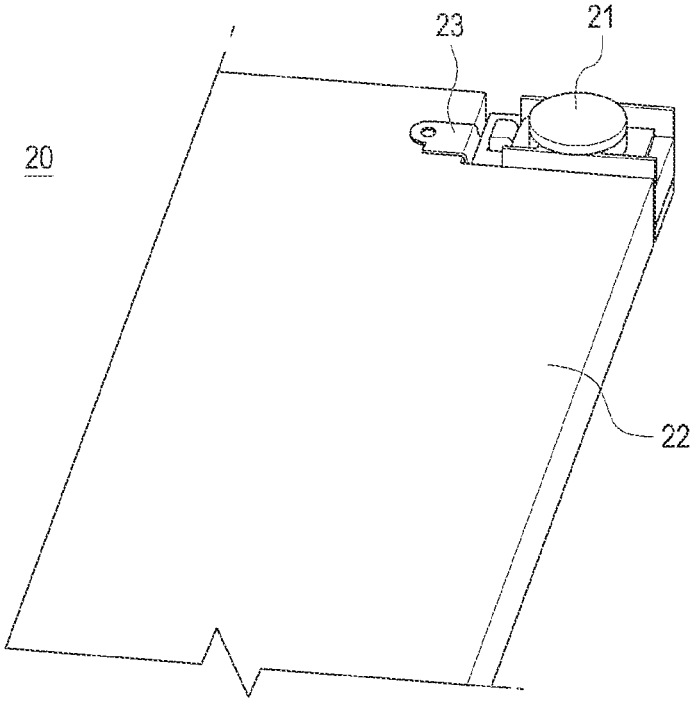
FIG.1B (PRIOR ART)

Hereinafter, various embodiments of the present invention are described in detail with reference to the accompanying drawings. When determined to make the subject matter of the present invention unclear, the detailed description of the known art or functions may be omitted. The terms as used herein are defined considering the functions in specific embodiments of the present invention and may be replaced with other terms according to the user's intention or custom. The terms may be more clearly defined by the description of various embodiments of the present invention. As used herein, the terms "first" and "second" are provided merely to distinguish components of the same name from each other, and the components may be referenced to have other various orders.

As used hereinafter, the term "electronic device" may be referred to as a terminal, a portable terminal, a mobile terminal, a communication terminal, a portable communication terminal, a portable mobile terminal, or a display device. For example, the electronic device may be a smartphone, a mobile phone, a navigation device, a game device, a TV, a head unit for vehicles, a laptop computer, a tablet computer, a personal media player (PMP), or a personal digital assistant (PDA). The electronic device may be implemented as a pocket-sized portable communication terminal with a radio communication function, and the electronic device may be a flexible device or a flexible display device.

According to an embodiment of the present invention, a circuit board device may include a connecting member for electrically connecting a base board with an electronic part. The connecting member is hereinafter referred to as the conductive elastic member. The term "electronic part" is hereinafter simply referred to as a "part". The conductive elastic member allows various installed positions for the part and the base board together with easy coupling therebetween.

In the circuit board device according to an embodiment of the present invention, the conductive elastic member may provide electrical connection between the part and the base board when the part and the base board are positioned side by side or stacked one over the other. The conductive elastic member may electrically connect the part with the base board regardless of directions in which the interconnect terminals of the part and the base board are provided. This enables more flexible installation of the part and the base board. The conductive elastic member may have various shapes or installed positions depending on the installed position of the part and the base board.

In the circuit board device according to an embodiment of the present invention, the conductive elastic member may provide various electrical connections depending on the installation type or position of the part and the base board. Further, according to an embodiment of the present invention, the conductive elastic member may facilitate assembly or disassembly of the part. The conductive elastic member does not require a separate fastening process (e.g., soldering), simplifying the overall process.

According to an embodiment of the present invention, the conductive elastic member enables an electrical connection between the part and the base board regardless of the positions of the part and the base board or the directions in which the interconnect terminals of the part and the base board are positioned.

According to an embodiment of the present invention, the shape or structure of the conductive elastic member may vary depending on the position of the interconnect terminal of the part, and is adaptable to the variation of the installed position or direction of the part. Further, according to an embodiment of the present invention, the conductive elastic member may have a plurality of interconnect ports, and the part may have a plurality of interconnect terminals. Accordingly, the coupling between the part and the base board may be further secured.

Figure 2:
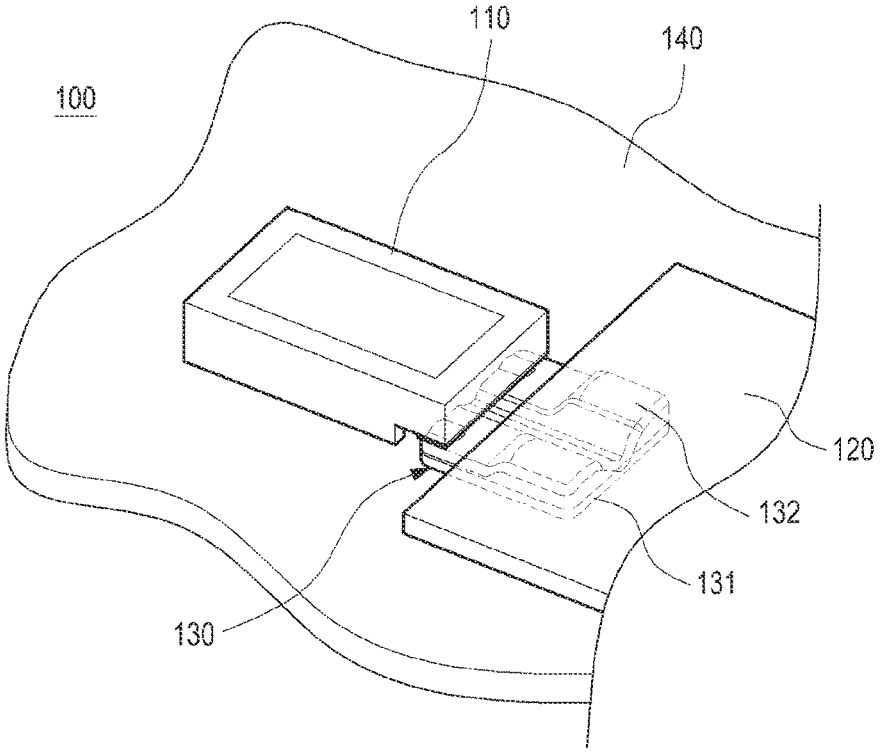
FIG. 2 is a perspective view schematically illustrating a printed circuit board device according to an embodiment of the present invention.
Figure 3:
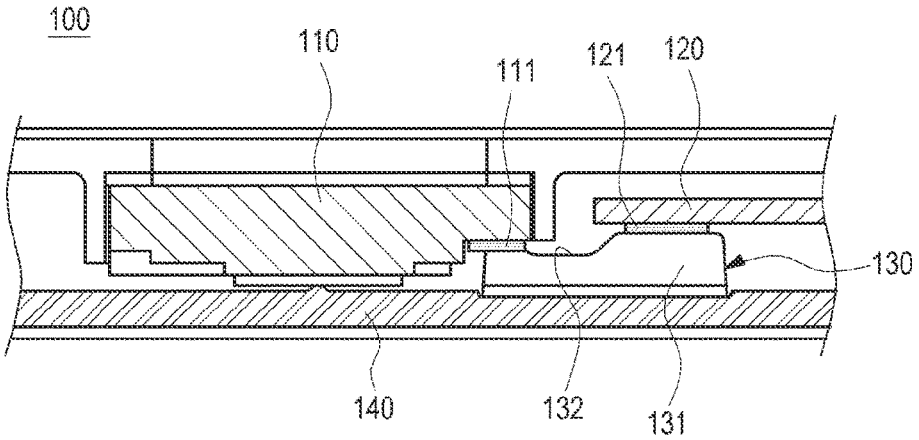
FIG. 3 is a cross-sectional view schematically illustrating a printed circuit board device according to an embodiment of the present invention.

FIG. 2 is a perspective view schematically illustrating a printed circuit board device according to an embodiment of the present invention. FIG. 3 is a cross-sectional view schematically illustrating a printed circuit board device according to an embodiment of the present invention.

Referring to FIGS. 2 and 3, according to an embodiment of the present invention, a printed circuit board device 100 includes a base board 120, at least one electronic component or part 110 (hereinafter part 110), and a conductive elastic member 130. A plurality of electronic components or parts 110 (hereinafter plurality of parts 110) may be installed on the base board 120, and the base board 120 may provide electrical connections between the plurality of parts 110. The base board 120 may be formed of a thin plate and may be mounted in an electronic device. The base board 120 may include a single-sided board with conductive wires provided only on one side thereof, a double-sided board, and a multi-layer board. A plurality of parts 110 are mounted on the base board 120 to be electrically connected with the conductive wires provided on the base board 120. According to an embodiment of the present invention, the conductive elastic member 130 electrically connects a conductive wire of the base board 120 (hereinafter, the conductive wire of the base board 120 is referred to as an interconnect terminal 121) with the part 110.

The part 110 may include conductive wires. According to an embodiment of the present invention, the conductive elastic member 130 electrically connects a conductive wire of the part 110 (hereinafter, the conductive wire of the part 110 is referred to as an interconnect terminal 111) with the base board 120.

The conductive elastic member 130 may include a non-conductive body 131 and an interconnect port 132. The conductive elastic member 130 provides connections for at least one or more ports, and thus, the body 131 may include as many interconnect ports 132 as the number of ports to be connected.

For the purpose of description, the conductive elastic member 130 includes one non-conductive body 131 and two interconnect ports 132 for connections for two ports. For the purpose of description, the conductive elastic member 130 connects the part 110 with the base board 120, and the part 110 and the interconnect terminal 121 are positioned side by side to each other in the same direction. However, the embodiments of the present invention are not limited thereto. For example, as described below in connection with FIG. 6, the body 131 and the interconnect port 132 may be formed of a non-conductive material (NCM) and a conductive material (CM), respectively. As described below in connection with FIGS. 7A to 14, the shape or structure of the body 131 or the interconnect port 132 may be varied depending on the installed position of the base board 120 or the part 110 or depending on the direction of the interconnect terminals 121 of the base board 120.

As described above, the conductive elastic member 130 may have various shapes or installed positions depending on the assembled positions of the base board 120 and the part 110, e.g., depending on whether the base board 120 and the part 110 are positioned side by side in a horizontal direction or are stacked one over the other in a vertical direction thereof. Further, the shape of the conductive elastic member 130 or the installed position of the interconnect port 132 may be varied depending on the installed direction of the interconnect terminal 121 of the base board 120 and the interconnect terminal 111 of the part 110.

Figure 4:
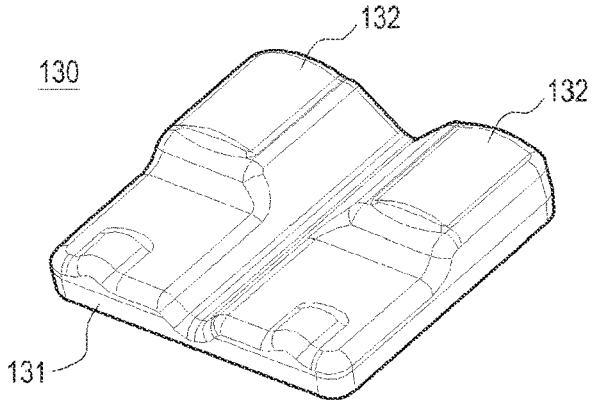
FIG. 4 is a perspective view schematically illustrating a conductive elastic member of a printed circuit board device according to an embodiment of the present invention.

FIG. 4 is a perspective view schematically illustrating a conductive elastic member of a printed circuit board device according to an embodiment of the present invention.

Referring to FIG. 4, the body 131 extends in a longitudinal direction thereof to connect the base board 120 and the part 110, which are spaced apart from each other while positioned side by side in a transverse direction thereof. At least one or more interconnect ports 132 are provided on a surface of the body 131. The body 131 may be formed of a non-conductive elastic material, such as silicone, rubber, an elastomer, or urethane, and the body 131 may be formed of an inelastic material such as plastics. The surface of the body 131 on which the interconnect ports 132 are provided may have a curved portion. For example, when the body 131 is formed of an elastic material and has a curved portion, the conductive elastic member 130 may be positioned between the base board 120 and the part 110 and may be compressed by the base board 120 and the part 110. As the curved portion is pressurized by the base board 120 and the part 110, the base board 120 and the part 110 may remain in stable contact with the base board 120 and the part 110.

Figure 5A:
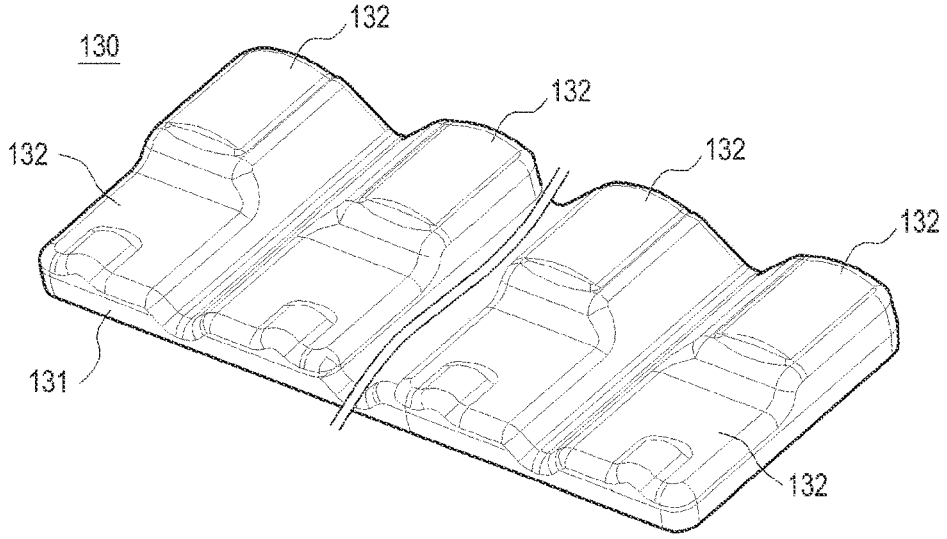
FIGS. 5A and 5B are views illustrating a conductive elastic member having a plurality of interconnect ports according to an embodiment of the present invention.
Figure 5B:
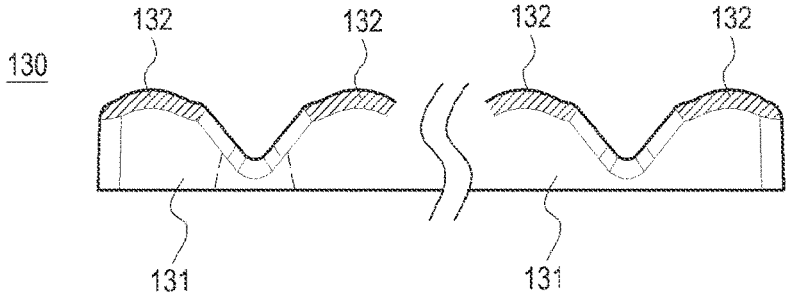

FIG. 5A is a perspective view schematically illustrating a conductive elastic member having a plurality of interconnect ports according to an embodiment of the present invention. FIG. 5B is a cross-sectional view schematically illustrating a conductive elastic member having a plurality of interconnect ports according to an embodiment of the present invention.

Referring to FIGS. 5A and 5B, the interconnect ports 132 are provided on a surface of the body 131, which corresponds to the curved portion according to an embodiment of the present invention. The number of interconnect ports 132 may vary depending on the number of parts 110 to be connected or the number of ports to be connected. For example, when one part 110 or one port is connected by the conductive elastic member 130, one interconnect port 132 may be provided on the body 131. In such a case, the interconnect port 132 may be provided on a longitudinal direction of the body 131 or along other various directions depending on the installed shape of the interconnect port 132. Further, when two or more parts or two or more ports are connected by the conductive elastic member 130, a plurality of interconnect ports 132 may be provided on the body 131. As described above, when the body 131 has a plurality of interconnect ports 132, the plurality of interconnect ports 132 may be provided on a longitudinal direction of the body 131 or in other various directions depending on the installed shape thereof. When a plurality of interconnect ports 132 are provided, the plurality of interconnect ports 132 positioned side by side may be spaced apart from each other by the non-conductive body 131. According to an embodiment of the present invention, the plurality of interconnect ports 132 positioned side by side may be connected with each other by way of a non-conductive groove shape.

The surface of the body 131 on which the interconnect ports 132 are provided may have different heights depending on the installed heights of the base board 120 and the part 110. For example, the surface of the body 131 may have a step depending on the difference between the installed position of the base board 120 and the installed position of the part 110. For example, when the interconnect terminal 121 of the base board 120 is formed to be higher than the interconnect terminal 111 of the part 110, the portion of the body 131 at which the interconnect port 132 contacting the interconnect terminal 121 of the base board 120 is positioned may be formed to be higher than the portion of the body 131 at which the interconnect port 132 contacting the interconnect terminal 111 of the part 110 is positioned. Accordingly, even when the base board 120 and the part 110 are not at the same height with respect to each other, the electrical connection between the base board 120 and the part 110 may maintain stable.

Various forms or shapes of the conductive elastic member 130 depending on the installed positions or shapes of the base board 120 and the part 110 are now described with reference to the drawings.

Figure 6:
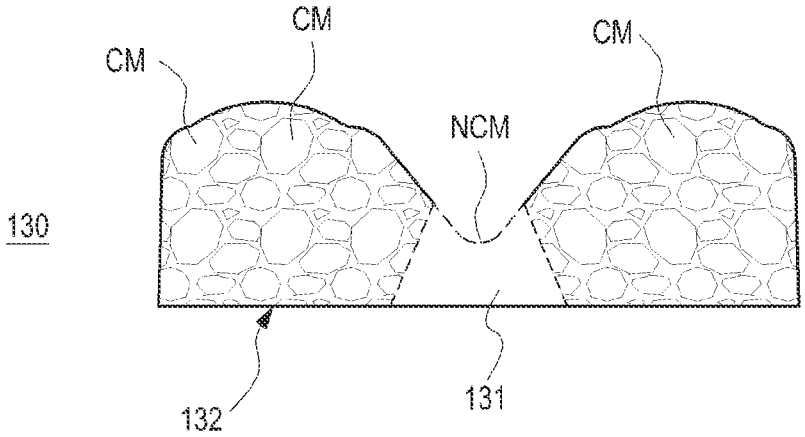
FIG. 6 is a cross-sectional view illustrating a conductive elastic member for a circuit board device according to an embodiment of the present invention.

FIG. 6 through FIG. 10 are views illustrating conductive elastic members for circuit board devices, according to various embodiments of the present invention. FIG. 6 is a cross-sectional view illustrating a conductive elastic member for a circuit board device according to an embodiment of the present invention.

Referring to FIG. 6, the interconnect port 132 and the body 131 may be integrally formed with each other. For example, the body 131 and the interconnect port 132 may be rendered to form a single body, e.g., by injecting-molding, compression-molding, extrusion-molding, hydraulic-molding, coating-molding, or insert-injecting a conductive material (CM) into a non-conductive material (NCM).

In this case, the conductive material may include, but is not limited to, gold, silver, copper, aluminum, and graphite, and the non-conductive material may include, but is not limited to, liquid silicone, rubber, elastomer, and urethane. When two or more interconnect ports 132 are provided on a body 131, a non-conductive connecting body may be injected into the space between two parallel interconnect ports 132, and the two interconnect ports 132 may be then injected onto two side surfaces, respectively, of the non-conductive connecting body. As such, the body 131 and the interconnect port 132 may be formed by double injection-molding. Alternatively, the body 131 and the interconnect port 132 may be formed by multi-component injection-molding. However, the body 131 and the interconnect port 132 may be manufactured by other various methods and with other structures, but are not limited thereto. For example, the interconnect port 132 forms a conductive member coated on an inside-empty body 131. As another example, the interconnect port 132 forms a conductive film laminated on an inside-empty body 131. As such, the conductive elastic member may have various modifications and changes in the shape, the manufacturing method, and the structure.

When the non-conductive body 131 is injection-molded together with a conductive member, the conductive member, itself, may play a role as an interconnect port 132. When a plurality of interconnect ports 132 are provided, the interconnect ports 132 may be connected with each other by the non-conductive connecting body 131. As described above, the non-conductive connecting body 131 is injection-molded to fit the installed position of the conductive elastic member 130 or the number or installed shape of ports to be connected, and the conductive members may be formed on the non-conductive connecting body 131 by, e.g., double injection-molding to connect the base board 120 with the part 110.

The body 131 and the interconnect port 132 of the conductive elastic member 130 may form a single body. For example, a conductive member for the interconnect port 132 may be integrally injection-molded to a non-conductive member, or the conductive elastic member 130 may be formed of pressure conductive rubber. The pressure conductive rubber refers to rubber that may turn conductive when pressurized. When the conductive elastic member 130 is formed of pressure conductive rubber, the body 131 connects the base board 120 and the part 110 with each other without the interconnect port 132. A portion of the pressure conductive rubber body 131 contacts the interconnect terminal 121 of the base board 120, and another portion thereof contacts the interconnect terminal 111 of the part 110. The contacted portions of the pressure conductive rubber body 131 are pressurized by the interconnect terminal 121 and the interconnect terminal 111, turning conductive and resultantly connecting the base board 120 with the part 110, like the interconnect port 132 does.

That, the body 131 may be integrally formed with the interconnect port 132, may mean that, similar to the pressure conductive rubber body, the conductive member and the non-conductive member form a single integral body without a separation between the body 131 and the interconnect port 132; while in some circumstances the non-conductive body 131 and the conductive interconnect port 132 may be distinct from each other. For example, the pressure conductive rubber body normally remains non-conductive, and when pressurized, partially turns conductive. The pressurized portion of the pressure conductive rubber body may function as the interconnect port 132 while the rest functions as the body 131.

Figure 7A:
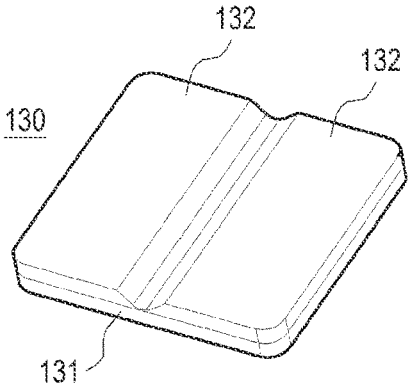
FIGS. 7A and 7B are perspective views illustrating conductive elastic members for circuit board devices, according to embodiments of the present invention.
Figure 7B:
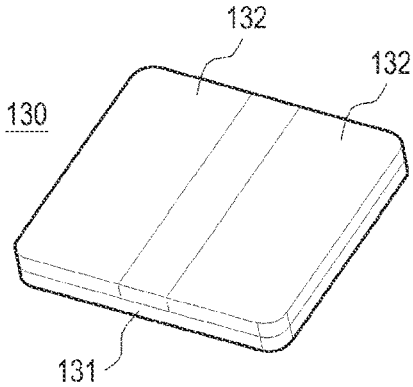

FIGS. 7A and 7B are perspective views illustrating conductive elastic members for circuit board devices, according to various embodiments of the present invention.

Referring to FIGS. 7A and 7B, the conductive elastic members may be substantially the same in structure and shape but differ in manufacturing method from those described above. While the above-described conductive elastic member is formed into a single body including the body 131 and the interconnect port 132 by injection-molding, extrusion-molding, compression-molding, extrusion-molding, hydraulic-molding, coating-molding, or insert injection-molding in the above embodiments, the conductive elastic member 130 according to another embodiment of the present invention may be manufactured by coating, plating, or depositing a conductive material on a non-conductive plate to form the interconnect port 132. In other words, the body 131 is shaped to be able to connect the interconnect terminal 121 of the base board 120 with the interconnect terminal 111 of the part 110, and a metal, such as, e.g., gold, silver, or copper, graphite, or other conductive material is coated, plated, or deposited on a surface of the body 131, thus forming the conductive elastic member 130. When a plurality of interconnect ports 132 are formed on the body 131, a groove may be formed between two parallel interconnect ports 132 depending on the installed position or shape of the conductive elastic member 130, or the body 131 and the interconnect ports 132 may be formed on the same plane, with the interconnect ports 132 electrically insulated from each other. However, the present invention is not limited thereto, and various changes in the form or shape may be made thereto.

Figure 8:
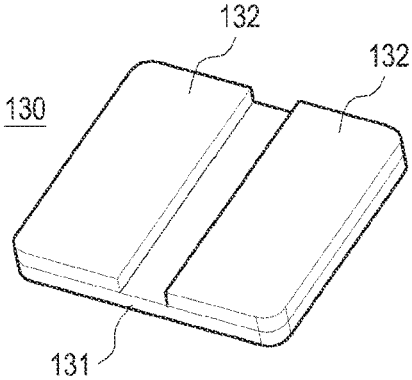
FIG. 8 is a perspective view illustrating a conductive elastic member for a circuit board device, according to an embodiment of the present invention.

FIG. 8 is a perspective view illustrating a conductive elastic member for a circuit board device, according to an embodiment of the present invention.

Referring to FIG. 8, the conductive elastic member may be substantially the same in structure and shape but differ in manufacturing method from those described above. The conductive elastic member 130 includes an interconnect port 132 formed of a conductive plate and a body 131 formed of a non-conductive plate. The conductive interconnect port 132 may be connected to the non-conductive body 131 by attaching (e.g., using a double-sided tape), thermal press, compression, or compression-molding.

For example, the non-conductive plate may be formed of silicone, rubber, elastomer, urethane, or plastic, and the conductive plate may be formed of gold, silver, copper, aluminum or other metals, or graphite. When a plurality of interconnect ports 132 are formed on the body 131, two parallel interconnect ports may be spaced apart from each other. Accordingly, the two parallel interconnect ports 132 may be electrically insulated from each other.

Figure 9:
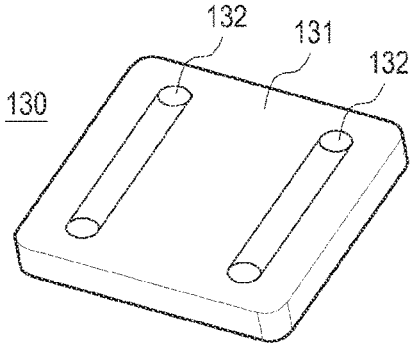
FIG. 9 is a perspective view illustrating a conductive elastic member for a circuit board device, according to an embodiment of the present invention.

FIG. 9 is a perspective view illustrating a conductive elastic member for a circuit board device, according to an embodiment of the present invention.

Referring to FIG. 9, the conductive elastic member may be substantially the same in structure and shape but differ in manufacturing method from those described above. The conductive elastic member 130 includes a body 131 formed of a non-conductive plate and a conductive pin-shaped interconnect port 132. The pin-shaped interconnect port 132 may be connected to the non-conductive body 131 by, e.g., attaching, insert-molding, thermal press, or compression, forming the conductive elastic member 130. For example, the non-conductive plate may be formed of silicone, rubber, elastomer, urethane, or plastic, and the pin-shaped interconnect port may be formed of gold, silver, copper, aluminum or other metals, or graphite. When a plurality of interconnect ports 132 are formed on the body 131, two parallel interconnect ports may be spaced apart from each other. Accordingly, the two parallel interconnect ports 132 may be electrically insulated from each other.

Figure 10:
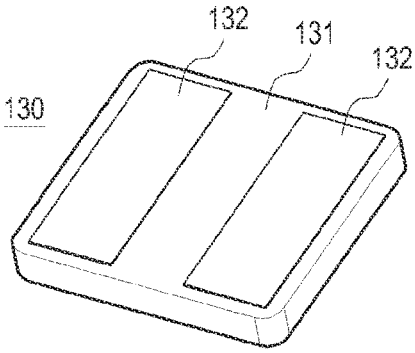
FIG. 10 is a perspective view illustrating a conductive elastic member for a circuit board device, according to an embodiment of the present invention.

FIG. 10 is a perspective view illustrating a conductive elastic member for a circuit board device, according to an embodiment of the present invention.

Referring to FIG. 10, the conductive elastic member may be substantially the same in structure and shape but differ in manufacturing method from those described above. The conductive elastic member 130 includes a non-conductive body 131 and a conductive interconnect port 132, and the conductive elastic member 130 may be formed by joining a conductive tape or fabric onto a non-conductive plate using, e.g., attaching, thermal press, or pressurization. The non-conductive body 131 may be formed of a silicone, rubber, elastomer, urethane, or plastic plate, and the conductive tape may include, e.g., a carbon tape or other conductive double-sided tapes. When a plurality of interconnect ports 132 are formed on the body 131, two parallel interconnect ports may be spaced apart from each other. Accordingly, the two parallel interconnect ports 132 may be electrically insulated from each other.

As set forth above, the body 131 and the interconnect port 132 of the conductive elastic member 130 may be formed by various methods. Some manufacturing methods and structures of the conductive elastic member 130 have been described above in connection with embodiments thereof, but other various modifications and changes may be made thereto as long as the conductive interconnect port 132 may be formed on the non-conductive body 131.

Various types of conductive elastic members 130 depending on the installed type of the base board 120 and the part 110 are described below with reference to FIGS. 11 to 15B.

The shape or connection structure of the conductive elastic member 130 may be varied depending on, e.g., the installed position of the base board 120 and the part 110. The interconnect terminal 111 of the part 110 may be positioned adjacent to the interconnect terminal 121 of the base board 120 in the same direction, an opposite direction, or a vertical direction of the interconnect terminal 121, or the interconnect terminal 111 of the part 110 may be positioned opposite the interconnect terminal 121 of the base board 120. The interconnect terminal 111 of the part 110 may be positioned at a front, rear, or side surface of the part 110 depending on the installed type of the part 110 and the base board 120. The interconnect terminal 111 may be provided at various positions of the part 110. At least one or more (e.g., two) interconnect terminals 111 may be provided on the part 110.

According to an embodiment of the present invention, a circuit board device has been described above in connection with FIGS. 2 and 3. Referring back to FIGS. 2 and 3, the interconnect terminal 111 of the part 110 and the interconnect terminal 121 of the base board 120 are positioned opposite each other in the same direction on a component provided inside the electronic device (the component is hereinafter referred to as a bracket 140). The interconnect terminal 121 of the base board 120 and the interconnect terminal 111 of the part 110 may be provided in the same direction. Accordingly, the conductive elastic member 130 may be formed in a longitudinal direction thereof. At least one or more interconnect ports 132 may be formed in a longitudinal direction thereof on a surface of the body 131 formed in a longitudinal direction thereof. In this case, the interconnect port 132 of the conductive elastic member 130 may be provided parallel to the interconnect terminal 121 of the base board 120 and the interconnect terminal 111 of the part 110, and the interconnect port 132 may come in contact with the interconnect terminal 111 of the part 110 and the interconnect terminal 121 of the base board 120.

Figure 11:
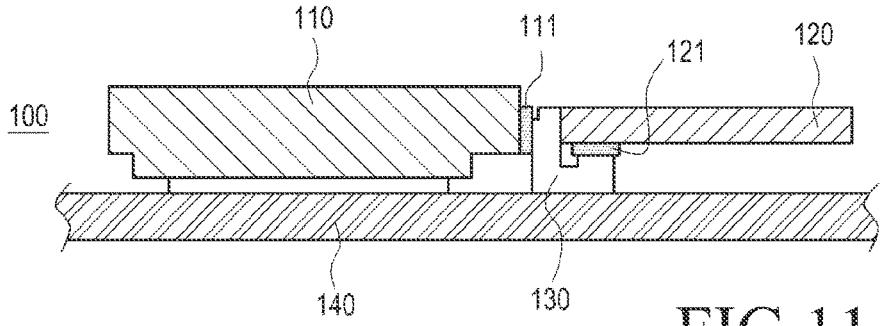
FIG. 11 is a cross-sectional view illustrating a circuit board device according to an embodiment of the present invention.

FIG. 11 is a cross-sectional view illustrating a circuit board device according to an embodiment of the present invention.

Referring to FIG. 11, the base board 120 and the part 110 are positioned opposite each other on the bracket 140. The interconnect terminal 121 of the base board 120 may be parallel to the bracket 140. The interconnect terminal 111 of the part 110 may be spaced apart from the interconnect terminal 121 of the base board 120 at a predetermined distance, with the interconnect terminal 111 positioned opposite the interconnect terminal 121. A side of the part 110 on which the interconnect terminal 111 of the part 110 is attached may be perpendicular to the interconnect terminal 121 of the base board 120. Accordingly, the interconnect terminal 111 of the part 110 may be positioned adjacent to the interconnect terminal 121 of the base board 120 in a direction perpendicular to the interconnect terminal 121. Accordingly, the conductive elastic member 130 provided between the base board 120 and the part 110 is shaped as the letter "L." The conductive elastic member 130 has an L-shaped body 131 and an interconnect port 132 formed along the surface of the L-shaped body 131. Accordingly, even when the interconnect terminal 111 of the part 110 and the interconnect terminal 121 of the base board 120 are positioned in directions perpendicular to each other, the conductive elastic member 130 may electrically connect the part 110 with the base board 120. According to an embodiment of the present invention, the conductive elastic member 130 may electrically connect the part 110 with the base board 120, with the part 110 and the base board 120 positioned adjacent to each other in a longitudinal direction thereof, and thus, the installation space and the stack thickness may be reduced.

Figure 12:
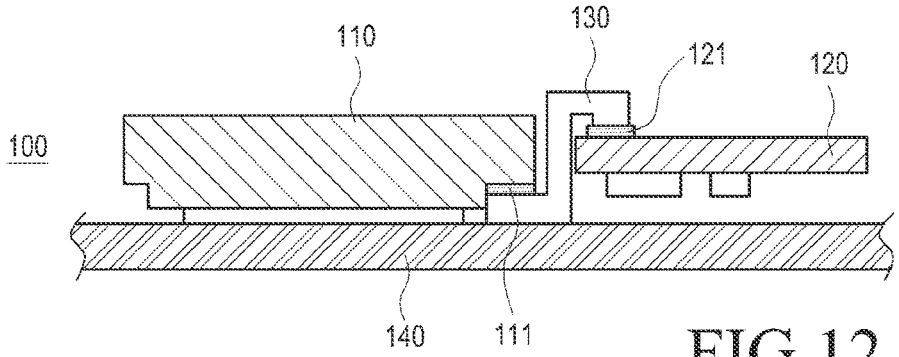
FIG. 12 is a cross-sectional view illustrating a circuit board device according to an embodiment of the present invention.

FIG. 12 is a cross-sectional view illustrating a circuit board device according to an embodiment of the present invention. Referring to FIG. 12, the base board 120 and the part 110 are positioned opposite each other on the bracket 140, similar to the configuration described above in connection with FIG. 11. However, the interconnect terminal 111 of the part 110 and the interconnect terminal 121 of the base board 120 are oriented in opposite directions thereof. The conductive elastic member 130 is provided between the base board 120 and the part 110 while passing through the space between the base board 120 and the part 110. In the conductive elastic member 130, a portion of the body 131 is vertically positioned between the base board 120 and the part 110 (hereinafter, the portion of the body 131 is referred to as a central portion of the body 131), and a first end of the central portion is bent to the part 110 while a second end thereof is bent to the base board 120. The first end and the second end of the body 131 are bent in directions away from each other with respect to the central portion of the body 131, and the first end of the body 131 connects to the interconnect port 132 at the side of the part 110 while the second end of the body 131 connects to the interconnect port 132 at the side of the base board 120. The interconnect port 132 may be formed along the surface of the body 131 to electrically connect the interconnect terminal 111 of the part 110 with the interconnect terminal 121 of the base board 120. Accordingly, even when the interconnect terminal 121 of the base board 120 and the interconnect terminal 111 of the part 110 are oriented in opposite directions thereof, the part 110 and the base board 120 may be electrically connected with each other, with the part 110 and the base board 120 placed in a longitudinal direction thereof, thus leading to a reduced installation space or stack thickness.

Figure 13:
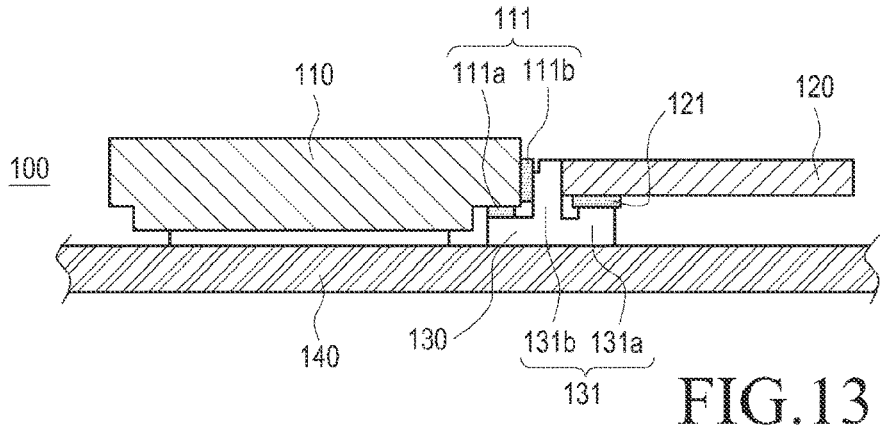
FIG. 13 is a cross-sectional view illustrating a circuit board device according to an embodiment of the present invention.

FIG. 13 is a cross-sectional view illustrating a circuit board device according to an embodiment of the present invention.

Referring to FIG. 13, the base board 120 and the part 110 are positioned opposite each other on the bracket 140. The part 110 may have a plurality of interconnect terminals 111 at different positions for a more reliable electrical connection with the base board 120. For example, the part 110 includes a first interconnect terminal 111*a* parallel to the bracket 140 and a second interconnect terminal 111*b* positioned adjacent to the first interconnect terminal 111*a* on a side surface of the part 110 and perpendicular to the bracket 140. The conductive elastic member 130 includes a first body 131*a* and a second body 131*b*. The first body 131*a* is formed in a longitudinal direction under the part 110 and the base board 120 that are arranged in the longitudinal direction. The second body 131*b* is positioned between a side surface of the base board 120 and a side surface of the part 110 in a direction perpendicular to the first body 131*a*. Two ends of the first body 131*a* respectively contact the first interconnect terminal 111*a* of the part 110 and the interconnect terminal 121 of the base board 120, and the second body 131*b* contacts the second interconnect terminal 111*b* of the part 110. The interconnect port 132 may be formed on the surface of the first body 131*a* and the second body 131*b* to connect the first interconnect terminal 111*a*, the second interconnect terminal 111*b* of the part 110, and the interconnect terminal 121 of the base board 120 with each other. As such, the part 110 has the second interconnect terminal 111*b* in addition to the first interconnect terminal 111*a*, thus providing for a more reliable electrical connection, secure coupling with the base board 120, and more flexibility in the installation or shape of the part 110.

Figure 14:
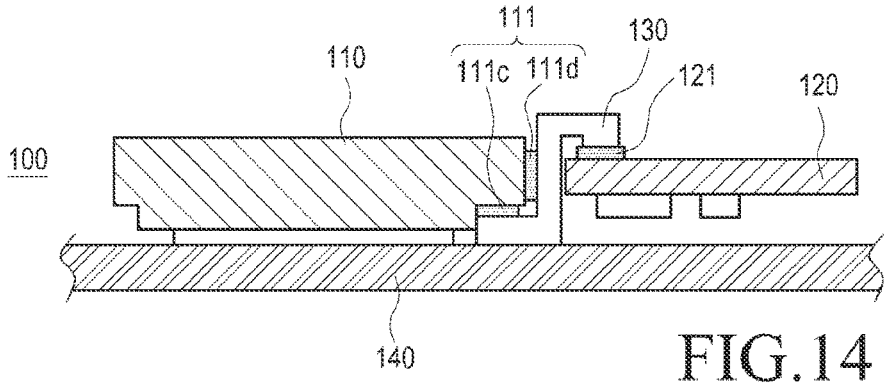
FIG. 14 is a cross-sectional view illustrating a circuit board device according to an embodiment of the present invention.

FIG. 14 is a cross-sectional view illustrating a circuit board device according to an embodiment of the present invention.

Referring to FIG. 14, the installed position of the base board 120 and the part 110 and the shape of the conductive elastic member 130 may be substantially the same as those described above in connection with FIG. 12. However, the circuit board device shown in FIG. 14 differs from the circuit board device shown in FIG. 12 in the number and position of interconnect terminals of the part 110. The conductive elastic member 130 is provided between the base board 120 and the part 110 while passing through the space between the base board 120 and the part 110. A portion of the body 131 is vertically positioned between the base board 120 and the part 110 (hereinafter, the portion of the body 131 is referred to as a central portion of the body 131), and a first end of the central portion is bent to be positioned between the part 110 and the bracket 140 while a second end of the central portion is bent to an interconnect terminal 121 formed on an upper portion of the base board 120. The first end and the second end of the body 131 are bent in directions away from each other with respect to the central portion of the body 131. The interconnect port 132 positioned at the first end of the body 131 is electrically connected with the interconnect terminal 111*c* of the part 110, and the interconnect port 132 positioned at the second end of the body 131 is electrically connected with the interconnect terminal 121 of the base board 120. According to an embodiment of the present invention, the part 110 includes at least two interconnect terminals 111. For example, the part 110 may include a third interconnect terminal 111*c* parallel to the bracket 140 and a fourth interconnect terminal 111*d* provided adjacent to the third interconnect terminal 111*c* and perpendicular to the third interconnect terminal 111*c*. The interconnect port 132 may be formed on the first and second end and the central portion of the body 131. As such, the conductive elastic member 130 includes the interconnect port that may be electrically connected to the fourth interconnect terminal 111*d* as well as the third interconnect terminal 111*c* of the part 110. As such, the interconnect port 132 formed on the body 131 of the conductive elastic member 130 may come in contact with the third interconnect terminal 111*c* and the fourth interconnect terminal 111*d* of the part 110, and the interconnect port 132 may extend and connect to the interconnect terminal 121 of the base board 120. According to an embodiment of the present invention, when the part 110 includes at least two interconnect terminals 111, the conductive elastic member 130 may have a plurality of interconnect ports 132 respectively connecting to the interconnect terminals 111, providing for a reliable electrical connection with the base board 120. Further, the installation space for connecting the base board 120 with the part 110 may be minimized, together with the stack thickness of the base board 120 and the part 110.

Figure 15A:
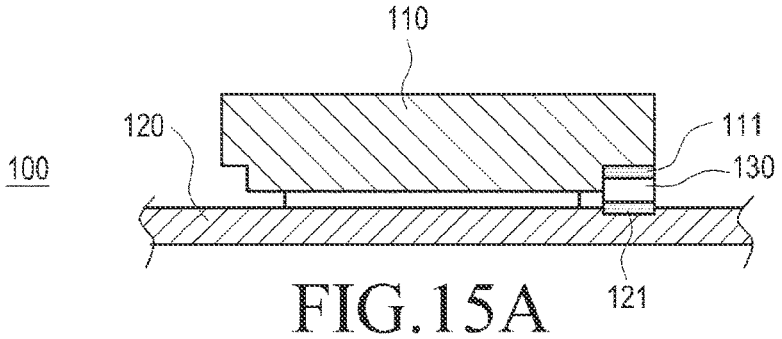
FIGS. 15A and 15B are cross-sectional views illustrating a circuit board device according to an embodiment of the present invention.
Figure 15B:
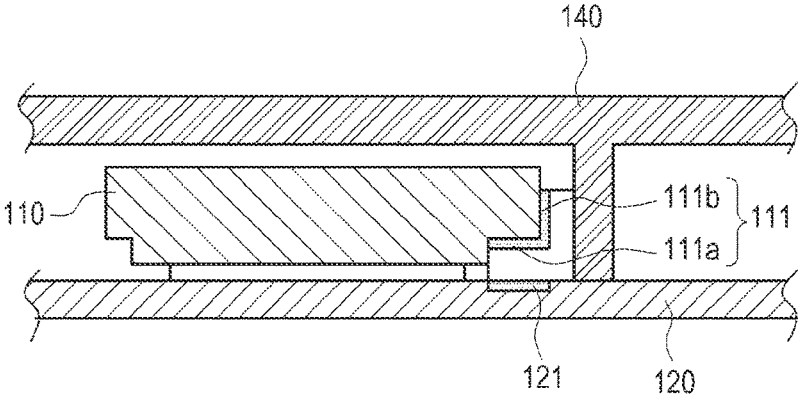

FIGS. 15A and 15B are cross-sectional views illustrating a circuit board device according to an embodiment of the present invention.

Referring to FIG. 15A, the part 110 is positioned on the base board 120, parallel to the base board 120. The conductive elastic member 130 is positioned between the part 110 and the base board 120. The bracket 140 may be positioned under the base board 120. The base board 120, the conductive elastic member 130, and the part 110 may be sequentially formed on the bracket 140. The base board 120 and the part 110 are stacked on the bracket 140, while parallel to each other. The interconnect terminal 121 of the base board 120 is positioned opposite the interconnect terminal 111 of the part 110 at a predetermined distance. The body 131 of the conductive elastic member 130 may be placed in a space between the base board 120 and the part 110, and the interconnect port 132 is connected to an upper surface and a lower surface of the body 131. When the part 110 is placed on the base board 120, the interconnect port 132 connected to the upper and lower surface of the body 131 is brought in contact with the interconnect terminal 121 of the base board 120 and the interconnect terminal 111 of the part 110, thus providing an electrical connection therebetween.

Referring to FIG. 15B, the part 110 includes a first interconnect terminal 111*a* parallel to the base board 120 and a second interconnect terminal 111*b* formed on a side surface of the part 110, adjacent to the first interconnect terminal 111*a*, and perpendicular to the interconnect terminal 121 of the base board 120. The conductive elastic member 130 connecting the base board 120 with the part 110 is shaped as the letter "L", and the interconnect port 132 may be formed on the surface of the body 131 to electrically connect the interconnect terminal 121 of the base board 120 with the first interconnect terminal 111*a* and second interconnect terminal 111*b* of the part 110.

Figure 16A:
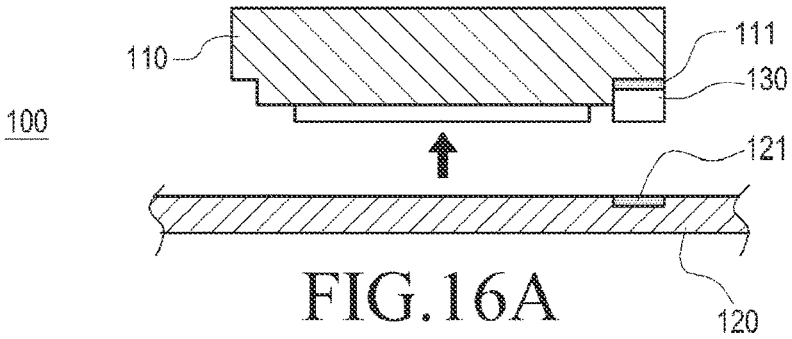
FIGS. 16A and 16B are views illustrating a coupling method of a conductive elastic member as shown in FIGS. 15A and 15B, according to an embodiment of the present invention.
Figure 16B:
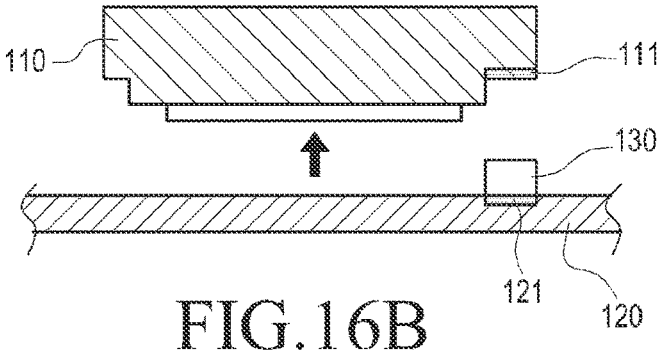

FIGS. 16A and 16B are views illustrating a coupling method of a conductive elastic member as shown in FIG. 15A, according to an embodiment of the present invention.

Referring to FIG. 16A, the conductive elastic member 130 is stacked on the base board 120 to be electrically connected with the base board 120, while being coupled to the interconnect terminal 111 of the part 110. For example, a surface of the interconnect port 132 formed on the body 131 of the conductive elastic member 130 may be connected to the interconnect terminal 111 of the part 110 by, e.g., assembling, inserting, or surface mounting (e.g., using a surface mounting device (SMD)). Under this circumstance, the part 110 may be stacked on (or positioned adjacent to) the base board 120 so that another surface of the interconnect port 132 is brought in contact with the interconnect terminal 121 of the base board 120.

Referring to FIG. 16B, the part 110 is stacked on the base board 120, with the conductive elastic member 130 coupled to the interconnect terminal 121 of the base board 120, providing an electrical connection between the base board 120 and the part 110. For example, a surface of the interconnect port 132 formed on the body 131 of the conductive elastic member 130 may be connected to the interconnect terminal 121 of the base board 120 by, e.g., assembling, inserting, or surface mounting (e.g., using a surface mounting device (SMD)). Under this circumstance, the part 110 may be stacked on (or positioned adjacent to) the base board 120 so that another surface of the interconnect port 132 is brought in contact with the interconnect terminal 111 of the part 110.

The configuration of coupling the conductive elastic member 130, when the base board 120 and the part 110 are stacked one over the other, has been described above in connection with FIGS. 16A and 16B, and such a configuration may be applicable to other embodiments of the present invention, in which the part 110 and the base board 120 are installed at different positions. For example, the part 110 and the base board 120 are installed on the bracket 140, with the part 110 and the base board 120 positioned side by side in a horizontal direction thereof. The conductive elastic member 130 is installed on the bracket 140. The interconnect terminal 121 of the base board 120 and the interconnect terminal 111 of the part 110 are positioned to contact the interconnect port 132 of the conductive elastic member 130, with the conductive elastic member 130 installed on the bracket 140.

As another example, the conductive elastic member 130 is coupled with the interconnect terminal 111 of the part 110. The part 110 is installed on the bracket 140, with the conductive elastic member 130 coupled with the interconnect terminal 111. Under this circumstance, the base board 120 is installed on the bracket 140 to contact the interconnect port 132 of the conductive elastic member 130 at a position adjacent to the part 110, providing for an electrical connection with the part 110.

The assembling may be conducted in different orders. For example, when the conductive elastic member 130 is coupled to the base board 120, the body 131 is coupled to the base board 120 so that the interconnect terminal 121 of the base board 120 contacts the interconnect port 132 positioned at a side of the body 131 of the conductive elastic member 130. The base board 120 is installed on the bracket 140, with the conductive elastic member 130 coupled with the base board 120. The part 110 is installed on the bracket 140 to contact the interconnect port 132 positioned at another side of the conductive elastic member 130, while positioned adjacent to the base board 120. Accordingly, the base board 120 and the part 110 may be electrically connected with each other through the conductive elastic member 130. Although some embodiments of the present invention have been described above, but the present invention is not limited thereto. The circuit board device 100 may be assembled in other various orders. In other words, the base board 120, the part 110, and the conductive elastic member 130 may be coupled with each other in different orders.

Figure 17A:
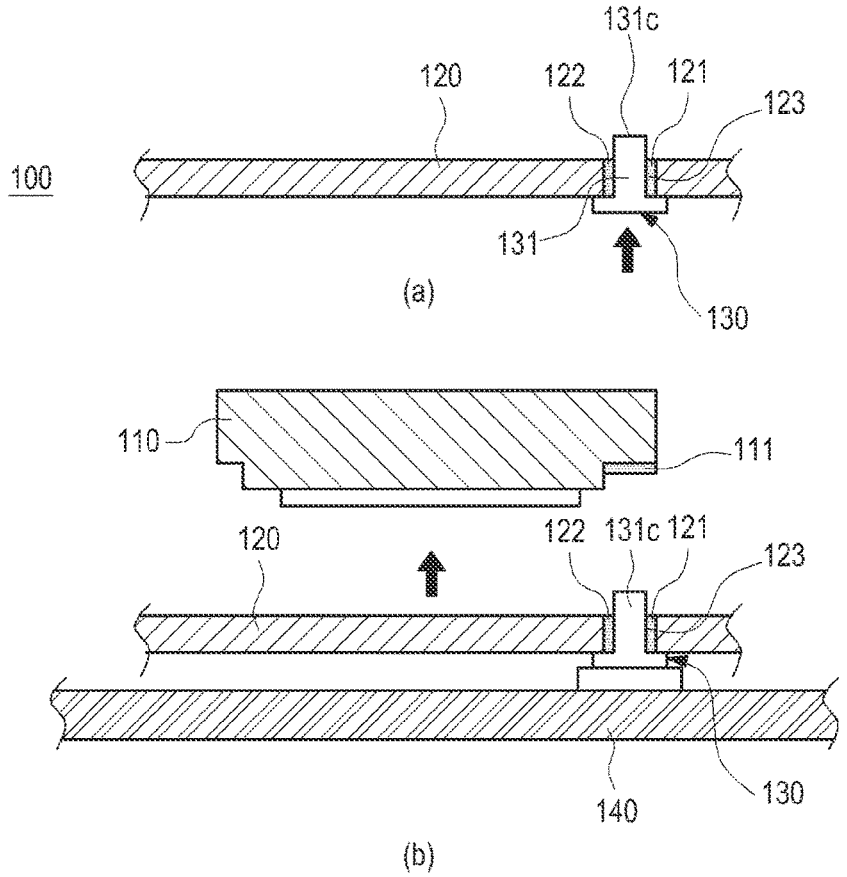
FIGS. 17A and 17B are views illustrating examples of assembling and installing a conductive elastic member in a circuit board device, according to embodiments of the present invention.
Figure 17B:
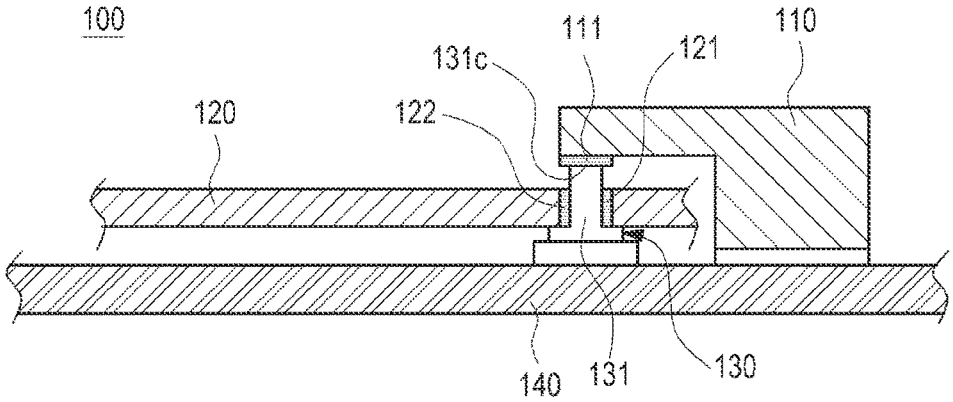

FIGS. 17A and 17B are views illustrating examples of assembling and installing a conductive elastic member in a circuit board device, according to embodiments of the present invention.

Referring to FIGS. 17A and 17B, the conductive elastic member 130 is coupled to the base board 120 through a via hole 123 of the base board 120, and the part 110 is stacked right on the base board 120. The body 131 of the conductive elastic member 130 is shaped as a reverse "T," and the interconnect port 132 is formed along the surface of a protrusion 131*c* inserted into the via hole 123. The interconnect terminal 121 of the base board 120 is positioned along an inner surface of the via hole 123. Accordingly, when the conductive elastic member 130 is coupled into the via hole 123, the interconnect terminal 121 of the base board 120 may be electrically connected with the interconnect port 132 of the conductive elastic member 130. Further, an additional interconnect terminal 122 of the base board 120 may be electrically connected with the interconnect port 132 of the conductive elastic member 130. As such, a simple coupling of the conductive elastic member 130 into the via hole 123 may provide an electrical connection between the base board 120 and the conductive elastic member 130. As described above, the conductive elastic member 130 may be coupled with the base board 120 through the via hole 123, and the passed-through portion of the conductive elastic member 130 is projected beyond a surface of the base board 120. The part 110 may be stacked adjacent to the base board 120 or stacked on the surface of the base board 120. The part 110 may be placed on the base board 120 or adjacent to the base board 120. For example, referring to FIG. 17A, the bracket 140, the base board 120, and the part 110 are sequentially stacked, and the conductive elastic member 130 passes through the via hole 123 of the base board 120 on the bracket 140 to thus contact the interconnect terminal 111 of the part 110. Further, referring to FIG. 17B, the base board 120 and the part 110 are positioned adjacent to each other on the bracket 140 in a horizontal direction on the bracket 140, and the conductive elastic member 130 is projected through the via hole 123 of the base board 120. An end of the part 110 extends to contact the protrusion of the conductive elastic member 130. When the part 110 is installed adjacent to the base board 120 in a horizontal direction, the end of the part 110 is brought in contact with the protrusion of the conductive elastic member 130, which is projected through the via hole 123, thus providing an electrical connection.

According to an embodiment of the present invention, the conductive elastic member may have various shapes or coupling types depending on the assembled structure of the part 110 and the base board 120. Various installation types or structures of the conductive elastic member depending on structures in which the part 110 and the base board 120 are coupled or installed on the bracket 140 are described below.

Figure 18:
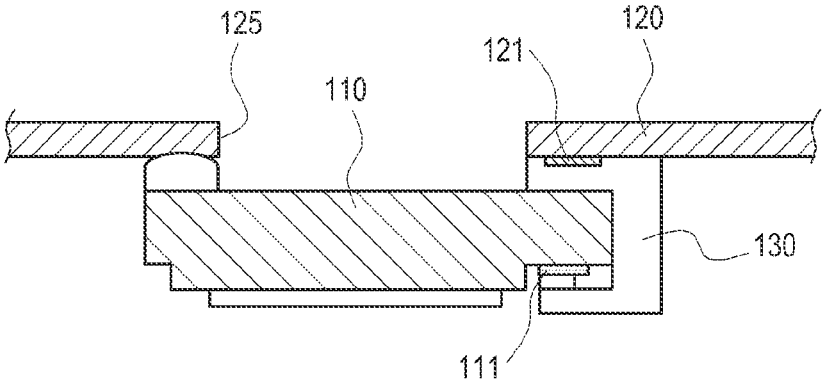
FIGS. 18 to 21, 22A, 22B, and 23 are views illustrating various conductive elastic members depending on types in which a base board and a part are installed on a bracket, according to embodiments of the present invention.
Figure 19:
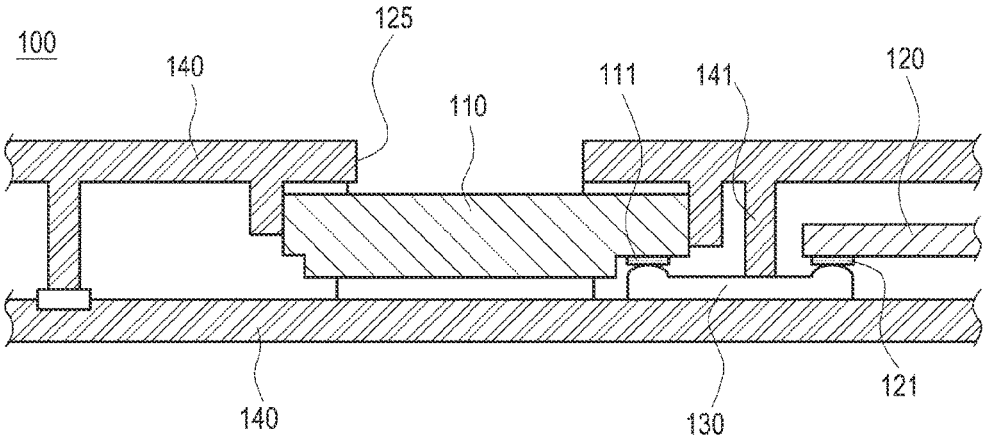
Figure 20:
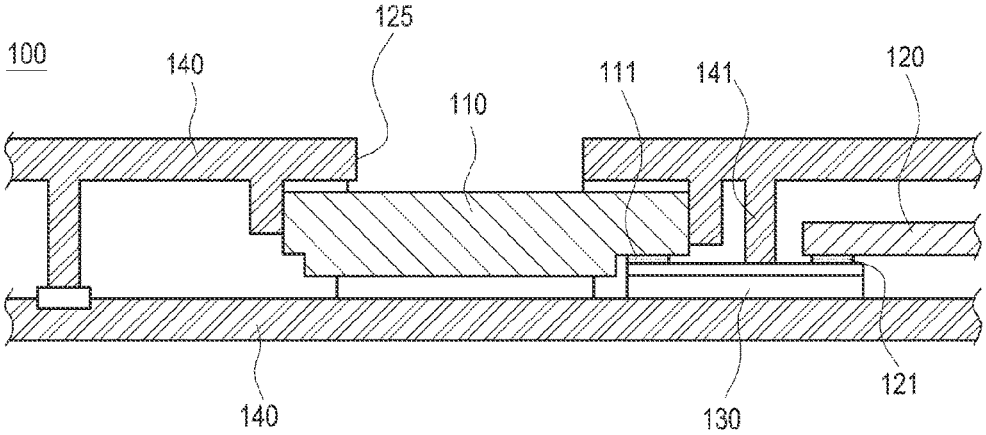

FIGS. 18 to 23 are views illustrating various conductive elastic members depending on types in which a base board and a part are installed on a bracket, according to various embodiments of the present invention. The conductive elastic member 130 as shown in FIGS. 18 to 20 is provided between the part 110 and the base board 120, and the conductive elastic member 130 may provide sealing.

Referring to FIGS. 18 to 20, the part 110, e.g., a speaker module, is positioned below a hole 125 for sound transmission that is formed. The space between the inside and outside of the base board 120 due to the hole 125 may be sealed. For example, when the part 110 is a speaker module, the space between the part 110 and the base board 120 may need to be sealed for guiding the sound output from the speaker module to the hole 125. Further, the sealing may be required for preventing foreign substances from coming in through between the base board 120 and the part 110.

Thus, a separate sealing member may need to be provided between the part 110 and the base board 120. According to an embodiment of the present invention, the sealing member may be replaced with the conductive elastic member 130. The conductive elastic member 130 between the part 110 and the base board 120 may provide for sealing as well as electrical connection between the part 110 and the base board 120. As described above, the body 131 of the conductive elastic member 130 is formed of an elastic material, such as silicone, rubber, elastomer, or urethane. The body 131 is provided between the base board 120 and the part 110 or a blocking wall 141 (refer to FIG. 19) protruded from the bracket 140 is brought in tight contact with a portion of the body 131, thus allow for sealing.

Referring to FIG. 18, the part 110, such as a speaker module, is installed inside the base board 120 to be exposed through the hole 125 of the base board 120. The conductive elastic member 130 is shaped as a lying 'U'. The part 110 is stacked under the hole 125 of the base board 120. The interconnect terminal 121 of the base board 120 and the interconnect terminal 111 of the part 110 face downward. The lying 'U'-shaped conductive elastic member 130 may electrically connect the interconnect terminal 121 of the base board 120 with the interconnect terminal 111 of the part 110. As the body 131 of the conductive elastic member 130 is compressed by the pressurization between the base board 120 and the part 110, the space between the base board 120 and the part 110 may be sealed.

Referring to FIGS. 19 and 20, the part 110 and the base board 120 are positioned adjacent to each other in a horizontal direction thereof, with the blocking wall 141 of the bracket 140 positioned therebetween. The interconnect terminal 121 of the base board 120 and the interconnect terminal 111 of the part 110 are positioned adjacent to each other in the horizontal direction, with the blocking wall 141 positioned therebetween. The body 131 of the conductive elastic member 130 between two opposite ends of the conductive elastic member 130 may be brought in tight contact with the blocking wall 141 and may be thus sealed. Accordingly, the conductive elastic member 130 may separate the space where the base board 120 is installed from the space where the part 110 is installed, while electrically connecting the interconnect terminal 121 of the base board 120 with the interconnect terminal 111 of the part 110. Therefore, the inflow of a foreign substance may be prevented, and when the part 110 is a speaker module, a better sound output may be obtained.

Figure 21:
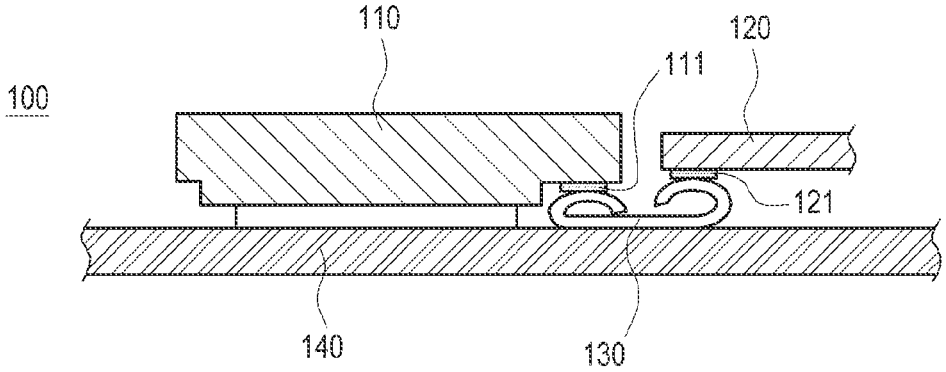
Figure 22A:
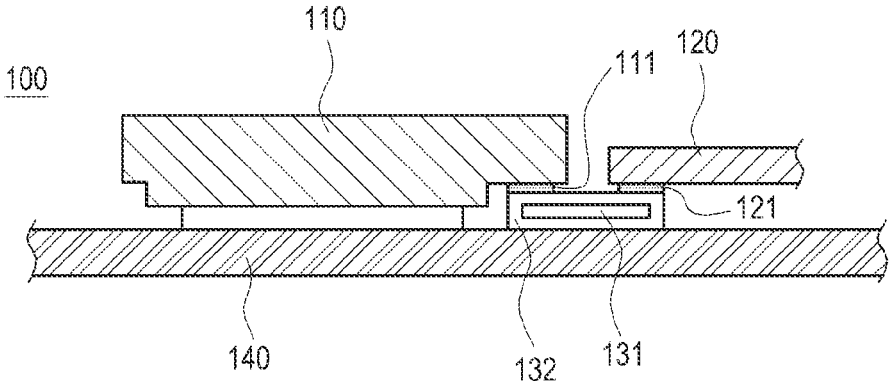
Figure 22B:
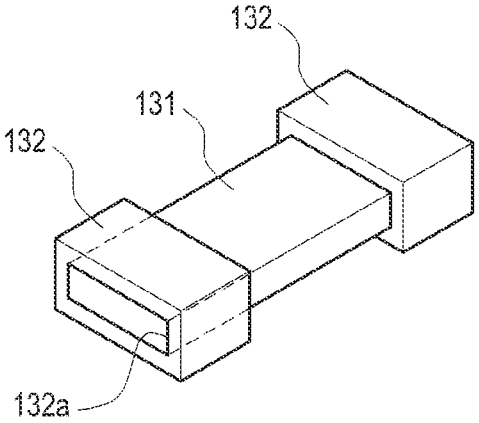
Figure 23:
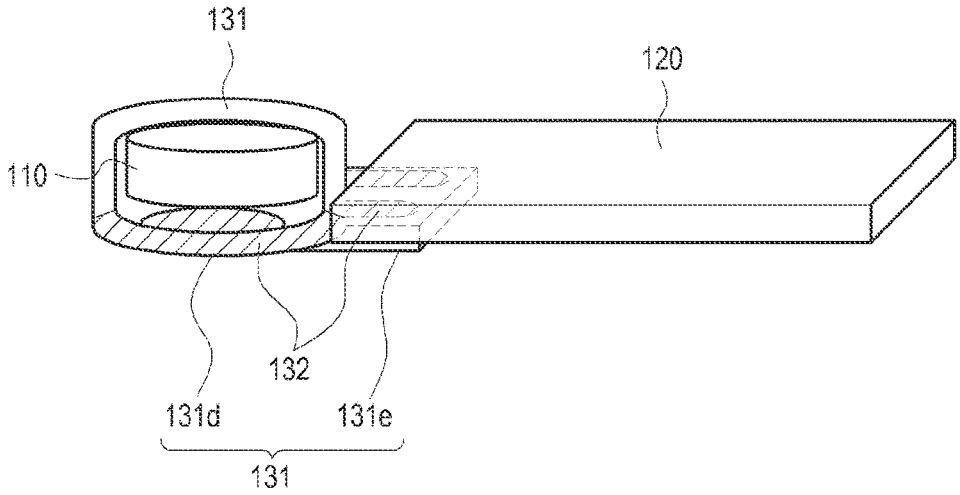

FIGS. 21 to 23 illustrate other types of conductive elastic members. As shown in FIGS. 21 to 23, the conductive elastic member may have various shapes for easier installation, fabrication, and assembly with the part or base board.

Referring to FIG. 21, according to an embodiment of the present invention, the conductive elastic member 130 have two opposite C-shaped ends. The C-shaped ends of the conductive elastic member 130, respectively, may contact and electrically connect to the interconnect terminal 121 of the base board 120 and the interconnect terminal 111 of the part 110. In this case, the two opposite ends of the conductive elastic member 130 may be pressurized as the base board 120 and the part 110 are seated on the bracket 140, keeping the contact and electrical connection stable. For example, the base board 120 and the part 110 are installed on the bracket 140, with the conductive elastic member 130 disposed therebetween, while the conductive elastic member 130 is coupled on the bracket 140. The interconnect terminal 121 of the base board 120 and the interconnect terminal 111 of the part 110 pressurize the respective end of the conductive elastic member 130. Accordingly, a coupling of the conductive elastic member 130 to the bracket 140 enables an electrical connection between the base board 120 and the part 110. Therefore, the base board 120, the part 110, and the conductive elastic member 130 may be easier to install, assemble, and detach, and more reliable electrical connection may be obtained.

Referring to FIGS. 22A and 22B, the non-conductive body 131 of the conductive elastic member 130 is inserted into the interconnect port 132 of the conductive elastic member 130. The conductive elastic member 130 includes the body 131 of a predetermined shape and the interconnect port 132 having a through hole 132*a* formed therethrough. According to an embodiment of the present invention, the body 131 may be detachable from the conductive elastic member 130, e.g., depending on the number of necessary interconnect ports 132. For example, upon connection of two interconnect ports 132 as shown in FIG. 22B, two opposite ends of the body 131 are inserted into the two interconnect ports 132, respectively. As such, the position of the interconnect port 132 of the conductive elastic member 130 may be varied, simplifying the structure and facilitating the assembly and installation.

As shown in FIG. 23, the part 110 is covered by the conductive elastic member 130 while seated in the conductive elastic member 130, depending on functions of the part 110. For example, the body 131 of the conductive elastic member 130 includes a first body 131*d* encompassing the part 110 and a second body 131*e* protruding from a side of the first body 131*d*. The interconnect port 132 may be connected between the inside of the first body 131*d* and the second body 131*e*. As the part 110 is placed in the first body 131*d*, the interconnect terminal 111 of the part 110 may be electrically connected with the interconnect port 132 on the first body 131*d*.

As described above, various changes may be made to the shape or structure of the conductive elastic member 130 depending on the type or position in which the base board 120 and the part 110 are installed or depending on the direction in which the interconnect terminal 121 of the base board 120 and the interconnect terminal 111 of the part 110 are arranged.

An example a fixture for fastening the conductive elastic member 130 to the bracket 140 or the base board 120 is described below.

Figure 24:
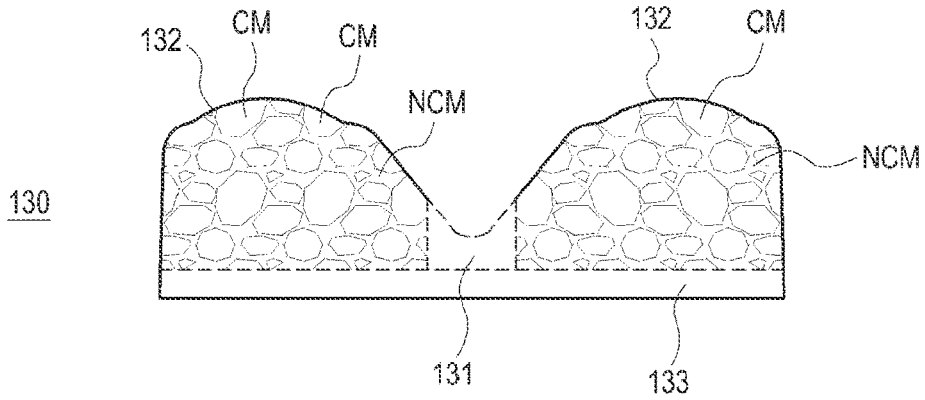
FIG. 24 is a perspective view illustrating a conductive elastic member for a circuit board device having a bottom portion, according to an embodiment of the present invention.

FIG. 24 is a cross-sectional view illustrating a conductive elastic member 130 with a bottom portion 133 in a circuit board device, according to an embodiment of the present invention. The conductive elastic member 130 shown in FIG. 24 may have substantially the same shape, type or structure as those described above, and thus, detailed description thereof is skipped. According to an embodiment of the present invention, the conductive elastic member 130 further includes the bottom portion 133 on a bottom surface thereof. For example, when non-conductive interconnect ports are formed on two opposite surfaces of the body, a non-conductive bottom portion 133 may be provided on the bottom surface of the conductive elastic member 130 to restrict an electrical connection through lower portions of the interconnect ports. The bottom portion 133 may be formed of an elastic material, thus providing more secure coupling and tighter contact. When a conductive interconnect port 132 is provided on a non-conductive plate in the above-described embodiment of the present invention, no separate bottom portion 132 may be provided.

Figure 25:
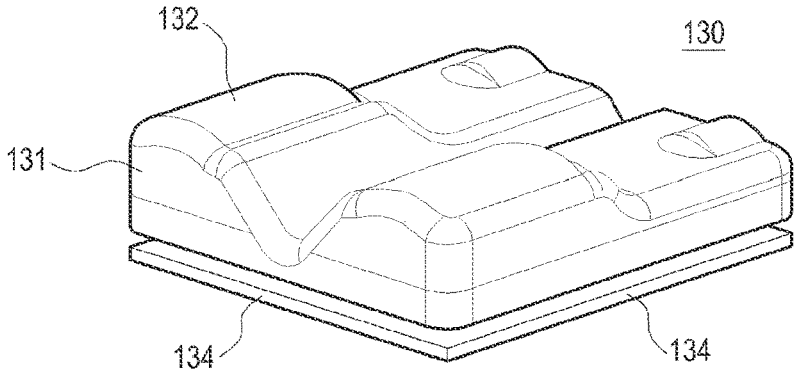
FIGS. 25, 26A-26D, 27A, and 27B are views illustrating conductive elastic members for circuit board devices, with various shapes of fixtures on the bottom surface, according to embodiments of the present invention.
Figure 26A:
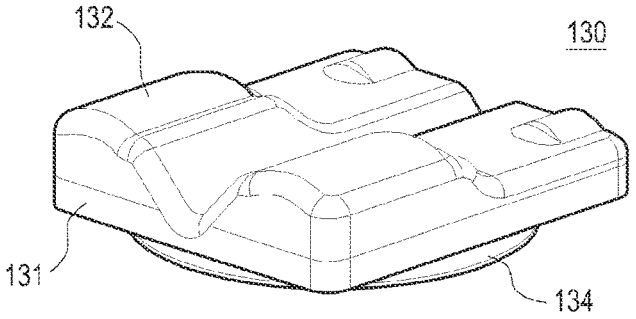
Figure 26B:
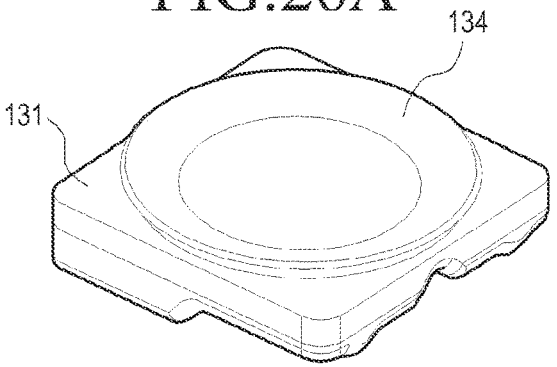
Figure 26C:
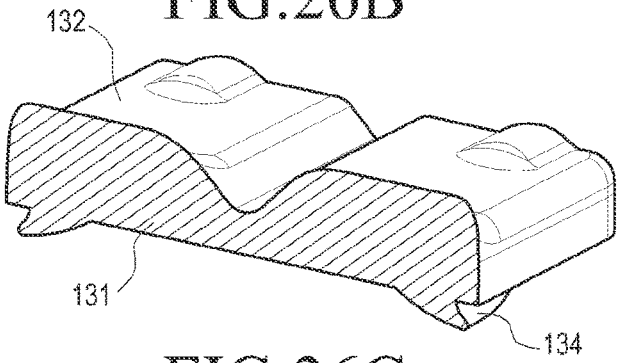
Figure 26D:
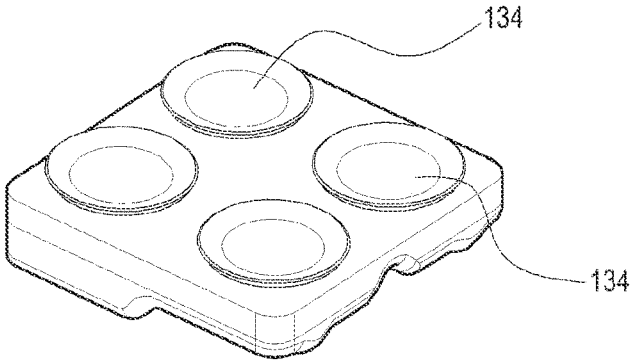
Figure 27A:
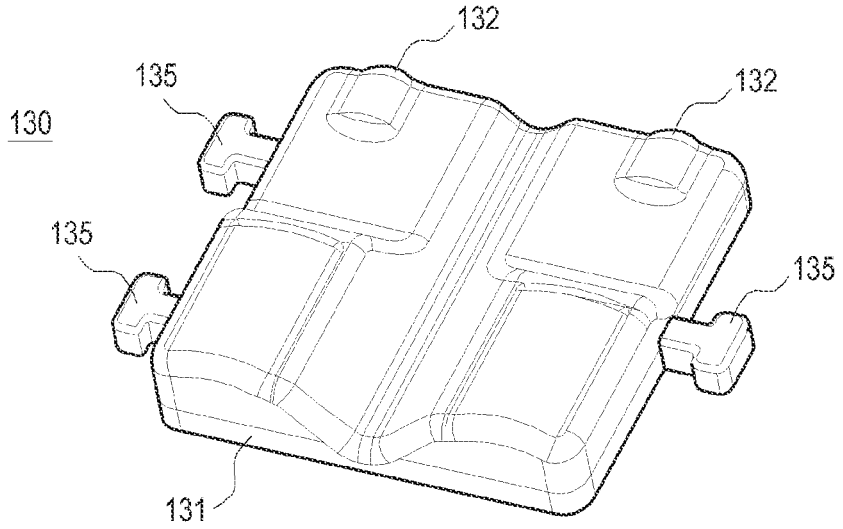
Figure 27B:
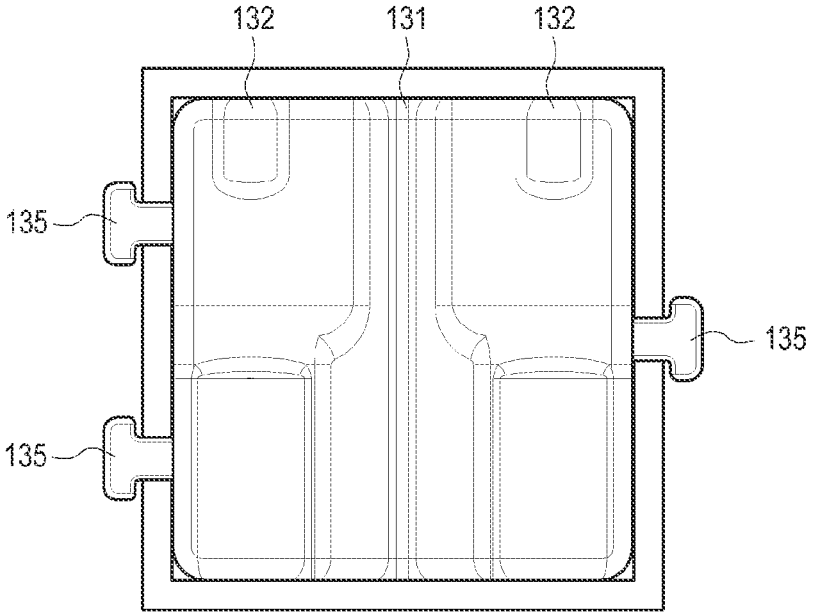

FIGS. 25 to 27B are views illustrating conductive elastic members for circuit board devices, with various shapes of fixtures on the bottom surface, according to various embodiments of the present invention. Referring to FIG. 25, according to an embodiment of the present invention, the conductive elastic member 130 further includes a fixture 134 on a surface thereof, to fasten the conductive elastic member 130 to, e.g., the bracket 140. The fixture 134 may be a double-sided tape. As shown in FIGS. 26A-26D, the fixture 134 includes a suction plate having a concave inner surface with respect to an external component. As shown in FIGS. 26A, 26B, and 26C, a single suction plate 134 is formed on the bottom surface of the body 131, or as shown in FIG. 26D, a plurality of suction plates 134 are formed on the bottom surface of the body 131 to be spaced apart from each other. Referring to FIGS. 27A and 27B, when the conductive elastic member 130 is inserted and fixed in the bracket 140 or the base board 120, the fixture includes protrusions 135 along an outer surface of the body 131 of the conductive elastic member 130 to provide secure coupling between the conductive elastic member 130 and the bracket 140 or the base board 120.

While the present invention has been shown and described with reference to certain embodiments thereof, it will be apparent to those of ordinary skill in the art that various changes in form and detail may be made thereto without departing from the spirit and scope of the present invention as defined by the appended claims and their equivalents.

What is claimed is:

1. A circuit board device, comprising:

a base board;

at least one electronic component; and a conductive elastic member configured to electrically connect the base board with the at least one electronic component, wherein the conductive elastic member comprises:

a non-conductive body having a top-side and a bottom-side, wherein the bottom-side does not contact the base board or the at least one electronic component; and two or more conductive interconnect ports provided on only the top-side of the non-conductive body and configured to electrically connect the base board with the at least one electronic component, wherein the two or more conductive interconnect ports are disposed at different heights on the top side of the non-conductive body, and wherein the conductive elastic member includes a conductive member that is formed on the non-conductive body and forms the two or more conductive interconnect ports.

2. The circuit board device of claim 1, wherein a shape of the non-conductive body and an installed position of the at least one conductive interconnect ports are varied depending on assembled positions of the base board and the at least one electronic component.

3. The circuit board device of claim 1, wherein, when a number of the at least one conductive interconnect ports is at least two, the conductive elastic member includes as many curved portions as the number of the at least one conductive interconnect ports.

4. The circuit board device of claim 1, wherein the at least one conductive interconnect ports has a same or different height depending on an installed height of an interconnect interface of the base board and an installed height of at least one interconnect interface of the at least one electronic component.

5. The circuit board device of claim 1, wherein the at least one conductive interconnect ports and the non-conductive body are formed by injection-molding, compression-molding, extrusion-molding, hydraulic-molding, coating-molding, or insert injection-molding a conductive material into a non-conductive material.

6. The circuit board device of claim 1, wherein the at least one conductive interconnect ports includes pressure conductive rubber.

7. The circuit board device of claim 1, wherein the at least one conductive interconnect ports includes a conductive material including at least one of gold, silver, copper, aluminum, and graphite.

8. The circuit board device of claim 1, wherein the non-conductive body includes a non-conductive material including a non-conductive elastic material or plastic.

9. The circuit board device of claim 1, wherein the non-conductive body includes at least one of an elastic material including silicone, rubber, elastomer, and urethane.

10. The circuit board device of claim 1, wherein an interconnect interface of the at least one electronic component is provided on a front surface, a rear surface, or a side surface of the at least one electronic component, and wherein the interconnect interface of the at least one electronic component is positioned adjacent to an interconnect interface of the base board in a same direction, an opposite direction, or a vertical direction of the interconnect interface of the base board, or at least one interconnect interface of the at least one electronic component is positioned opposite the interconnect interface of the base board.

11. The circuit board device of claim 10, wherein the at least one interconnect interface of the at least one electronic component and the interconnect interface of the base board are positioned adjacent to each other in the same direction, and wherein the at least one conductive interconnect ports is formed in a longitudinal direction thereof, and contacts the interconnect interface of the at least one electronic component and the interconnect interface of the base board.

12. A circuit board device, comprising:

a base board;

at least one electronic component; and a conductive elastic member configured to electrically connect the base board with the at least one electronic component, wherein the conductive elastic member comprises:

a non-conductive body; and a plurality of conductive interconnect ports provided on a surface of a non-conductive body to be spaced apart from each other and configured to electrically connect an interconnect interface of the base board with an interconnect interface of the at least one electronic component, wherein the plurality of the conductive interconnect ports are disposed at different heights on the top side of the non-conductive body, and wherein the conductive elastic member includes a conductive member that is formed on the non-conductive body and forms the plurality of the interconnect ports.

13. The circuit board device of claim 12, wherein the plurality of conductive interconnect ports protrude on a surface of the non-conductive body.

* * * * *